US012721446B2

(12) United States Patent
Altemimei

(10) Patent No.: US 12,721,446 B2
(45) Date of Patent: Sep. 1, 2026

(54) SEATING SYSTEM WITH INDEPENDENT SUSPENSION

(71) Applicant: DA International, Inc., Orland Park, IL (US)

(72) Inventor: Raad Altemimei, Orland Park, IL (US)

(73) Assignee: DA International, Inc., Orland Park, IL (US)

( * ) Notice: Subject to any disclaimer, the term of this patent is extended or adjusted under 35 U.S.C. 154(b) by 288 days.

(21) Appl. No.: 18/484,299

(22) Filed: Oct. 10, 2023

(65) Prior Publication Data

US 2025/0113919 A1 Apr. 10, 2025

(51) Int. Cl.
*A47C 13/00* (2006.01)
*A47C 7/35* (2006.01)

(52) U.S. Cl.
CPC ..... *A47C 13/005* (2013.01); *A47C 7/35* (2013.01)

(58) Field of Classification Search
CPC ..... A47C 13/005; A47C 7/35
USPC ..... 297/440.22, 452.54, 452.55, 452.56
See application file for complete search history.

(56) References Cited

U.S. PATENT DOCUMENTS 4,886,250 A * 12/1989 Lucas ..... 267/89
5,918,944 A * 7/1999 Dietrich ..... A47C 7/347 297/452.5
2005/0052068 A1* 3/2005 Smith ..... 297/452.54

FOREIGN PATENT DOCUMENTS

GB 2276316 A * 9/1994 ..... A47C 27/07

* cited by examiner

*Primary Examiner* — Anthony D Barfield
(74) *Attorney, Agent, or Firm* — Richard C. Himelhoch; UB Greensfelder LLP

(57) ABSTRACT

An independent suspension system for a seating system having a support structure within a base portion of the seating system is provided. The support structure contains a resilient compressible element and spaces the resilient compressible element from the walls of the base portion. The resilient compressible element can contain one or more spring elements and/or one or more elastic elements. The resilient compressible element has an upper surface supporting a layer or padding. An outer material encloses the base. The independent suspension system inhibits wrinkling and/or bunching of the material covering the base.

16 Claims, 7 Drawing Sheets

SEATING SYSTEM WITH INDEPENDENT SUSPENSION

CROSS-REFERENCE TO RELATED APPLICATIONS

None.

FEDERALLY SPONSORED RESEARCH OR DEVELOPMENT

N/A

FIELD OF THE INVENTION

The present invention is generally directed to an independent suspension structure for use in a seating system, and more particularly, to an independent internal suspension that is spaced from the outer walls of a seating system, such as a couch, seat, ottoman, sectional piece or other similar furniture.

DESCRIPTION OF THE PRIOR ART

Comfortable furniture, such as a chair or seat, a couch-including pieces of a sectional couch or seating system, an ottoman, and other similar items, typically include cushioning (or padding) and/or pillows, and a suspension system supporting the cushioning and pillows. The suspension system is typically formed in a base portion of the piece of furniture and can include a rigid support structure for positioning the cushioning or pillows, as well as a resilient or compressive elements-such as springs or other similar materials or structures. The suspension system can be adjusted to provide the proper or desired amount of firmness for the furniture.

In many instances, an outer covering of some furniture can exhibit wrinkling or bunching of the material. This can happen immediately or after some use or extended use.

The present invention provides a suspension system that is independent of the outer side walls of a seating system. This independent suspension inhibits or eliminates wrinkling of the outer material layer of the seating system.

SUMMARY OF THE INVENTION

The present invention is directed to an independent suspension system for use in a piece of furniture. The suspension system includes a support structure and a resilient and/or compressible, spring-like element. The support structure spaces the resilient compressible element from the outer walls of the base of the piece of furniture. This spacing inhibits or eliminates formation of wrinkles in the outer material layer (e.g., fabric, leather, or other materials) of the furniture.

In accordance with one aspect of the invention, a seating system with an independent suspension system is provided. The system comprises a base having an outer side wall defining an outer side perimeter of the seating system. The outer wall forms an upper opening. A suspension system is positioned within the perimeter of the outer side wall. The suspension system includes a generally rigid support structure and a resilient compressible element connected to the support structure. The resilient compressible element has an upper support surface. The support structure is constructed so that it spaces the resilient compressible element from a first portion of the outer side wall. A cushion layer is supported on the upper support surface of the resilient compressible element and an outer layer of material covers the cushion layer and spans the opening defined by the outer side wall.

The outer side wall can be formed to include a first side wall portion, a second side wall portion opposing and spaced from the first side wall portion, a third side wall portion and a fourth side wall portion opposing and spaced from the third side wall portion. The side wall portions form a rectangular outer box. The suspension system is supported within the outer box.

The support structure spaces the resilient compressible element from the first side wall portion. Additionally, the support structure spaces the resilient compressible element from the second side wall portion. The support structure can also space the resilient compressible element from the third side wall portion and the fourth side wall portion. Moreover, the support structure positions the resilient compressible element below a top of the outer side wall.

The support structure can include a first beam extending generally from the third side wall portion to the fourth side wall portion and spaced from the first side wall portion, and a second beam also generally extending from the third side wall portion to the fourth side wall portion, and spaced from the fourth side wall portion. Additionally, the support structure can include a first cross-beam extending from the first beam to the second beam, and a second cross-beam extending from the first beam to the second beam and spaced from the first cross-beam. The beams and cross-beams form a generally rectangular opening within the opening defined by the outer wall of the base. The resilient compressible element spans the opening defined by the beams and cross-beams.

The resilient compressive element can include a plurality of spaced apart spring elements extending from one of the pair of beams and/or cross-beams. Similarly, the resilient compressive element can include a plurality of spaced apart elastic straps extending from one of the pair of beams and/or cross-beams.

The resilient compressive element can include a layer of material above the plurality of spring elements and/or the plurality of elastic straps. The layer of material provides an upper surface for the element. The cushion layer is supported on the upper surface of the layer of material of the resilient compressive member.

The suspension system can be installed as part of an ottoman. The suspension system can also be installed in other similar furniture, such as seats or chairs, couches, pieces of sectional couch, etc.

In accordance with another aspect of the invention, a seating system having an independent suspension system is provided. The system comprises a base portion having a first side wall portion, a second side wall portion spaced from and parallel to the first side wall portion, a third side wall portion perpendicular to the first side wall portion and the second side wall portion, and a fourth side wall portion spaced from and parallel to the third side wall portion. The first side wall portion, the second side wall portion, the third side wall portion and the fourth side wall portion form a generally rectangular outer wall of the base portion. A support structure within the outer wall of the base portion has a first beam spaced from and generally parallel to the first side wall portion and a second beam spaced from and generally parallel to the second side wall portion. A compressible portion is connected to and extending between the first beam and the second beam.

The compressible portion can include a plurality of spring elements and/or a plurality of elastic bands. The seating system can also include an outer material covering a top portion of the base portion. The seating system can be an ottoman or other similar furniture.

Other features and advantages of the invention will be apparent from the following specification taken in conjunction with the following Figures.

BRIEF DESCRIPTION OF THE DRAWINGS

To understand the present invention, it will now be described by way of example, with reference to the accompanying drawings and attachments in which.

DETAILED DESCRIPTION

Figure 1:
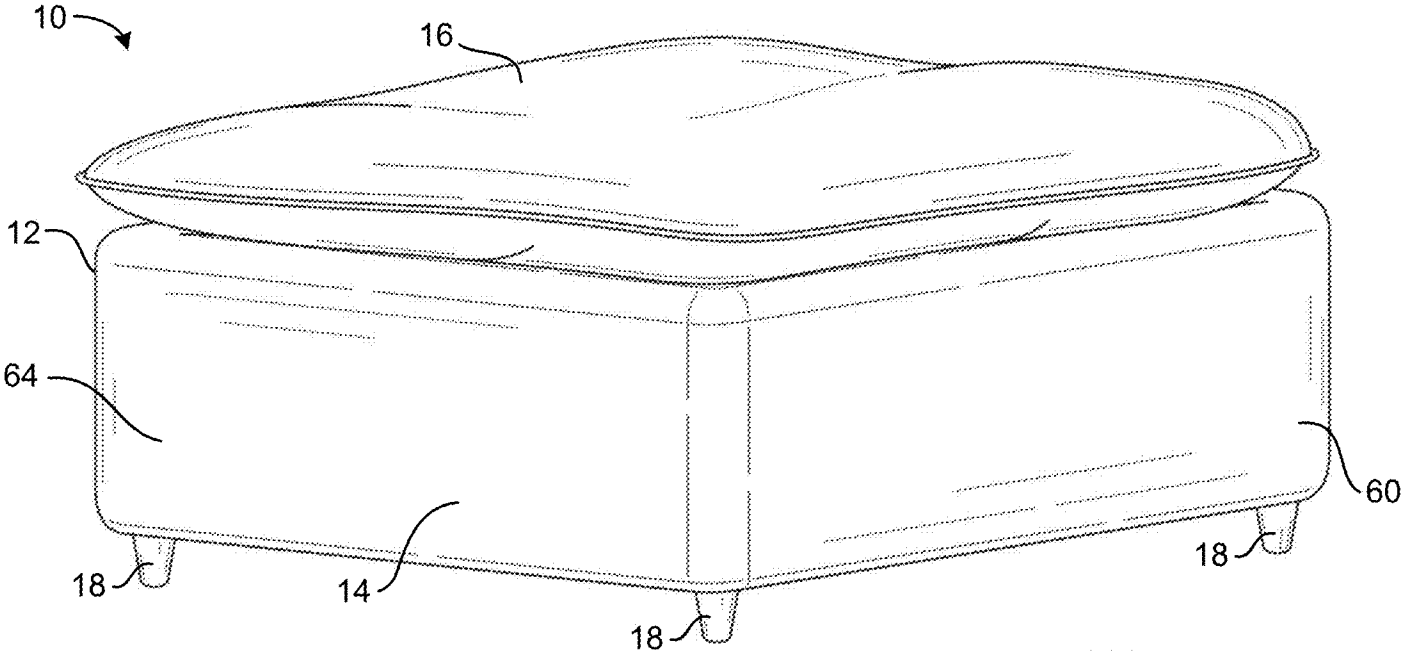
FIG. 1 is a perspective view of an ottoman having an independent suspension system in accordance with the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 6:
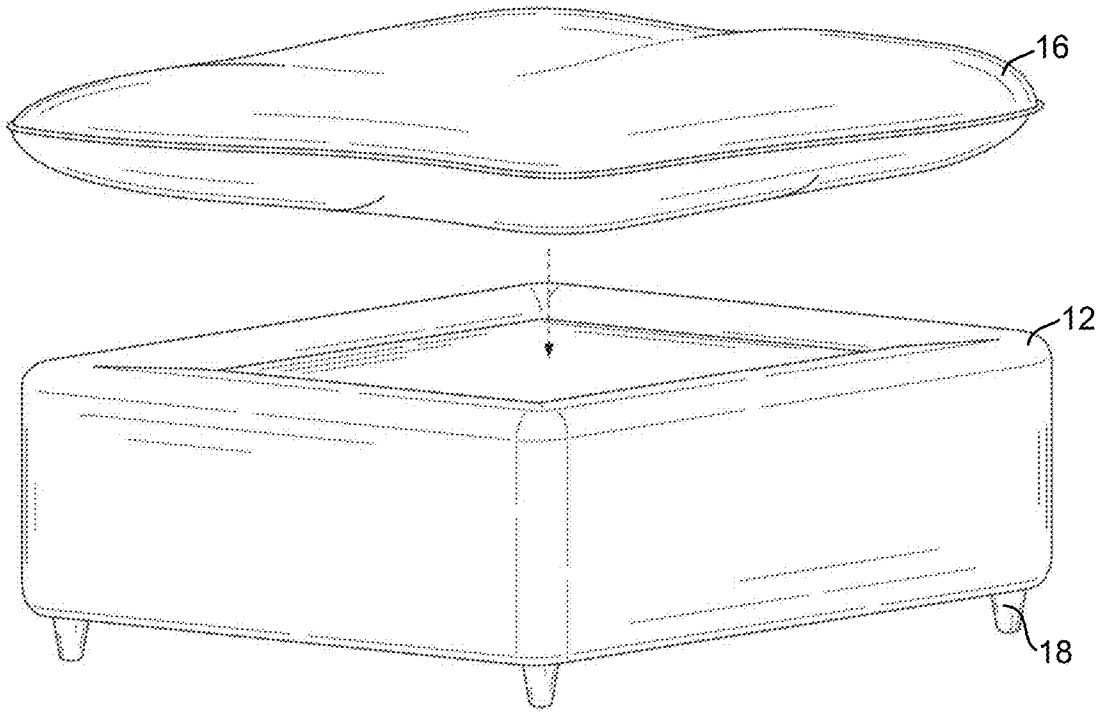

FIG. 1 shows a piece of furniture—in this instance an ottoman 10—which utilizes the independent suspension system of the present invention. The ottoman 10 includes a generally square base 12 having an outer side wall 14 (in four side wall sections or portions) defining an outer perimeter of the base 12. A pillow or cushion 16 is placed or secured on an upper surface of the base 12, and legs 18 extend below a lower surface of the base 12 at each corner. An exploded view of the base 12 and pillow 16 is shown in FIG. 6.

Figure 2:
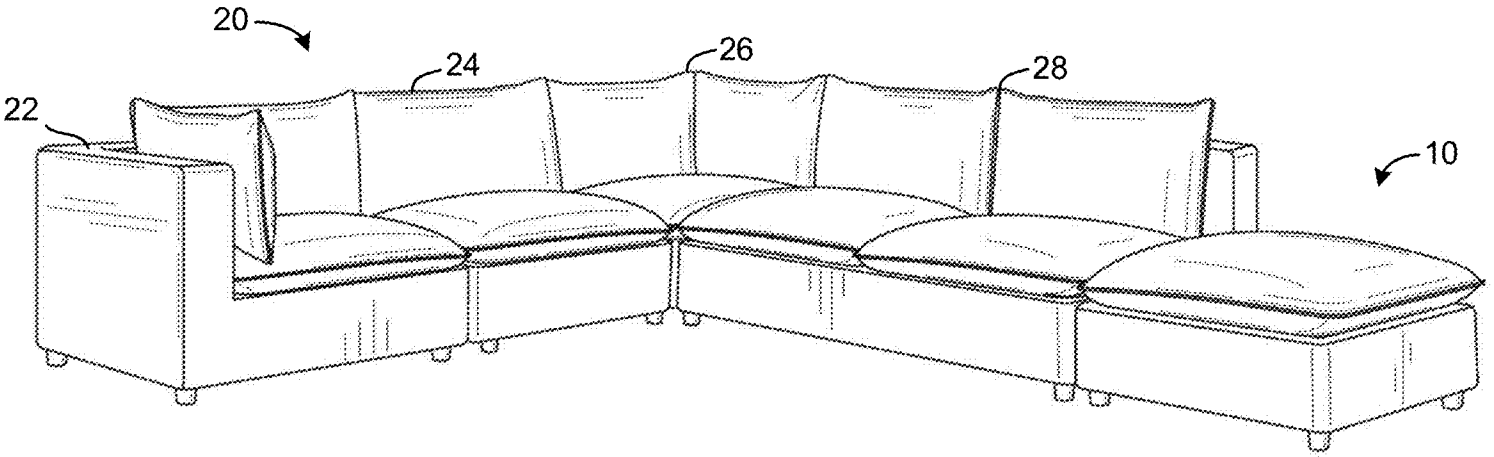
FIG. 2 is a perspective view of a sectional couch and the ottoman of FIG. 1 where each component has an independent suspension system in accordance with the present invention.

As shown in FIG. 2, other types of furniture, like components of a sectional couch 20, can also use the independent suspension system of the present invention. The components of the sectional couch 20 can include an end unit 22, an individual seat 24, a corner piece 26, an elongated seat unit 28 and the ottoman 10. Other similar components can be included depending on the size and ultimate shape of the couch 20. The suspension system can also be used in other similar types of furniture not shown. Each of the components of the sectional couch 20 includes a base having an outer side wall. Additionally, each piece of furniture includes an outer covering, such as a fabric, leather or other similar or suitable material.

Figure 4:
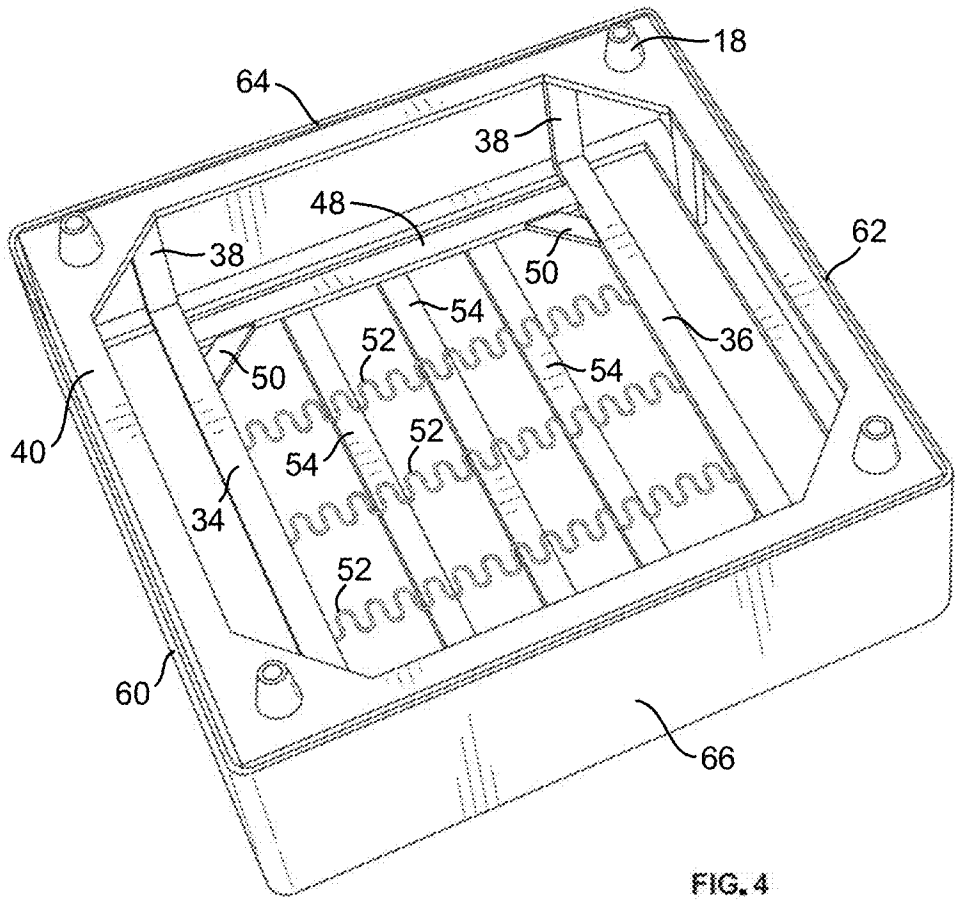
FIG. 4 is a perspective bottom view of the ottoman of FIG. 1 rotated −90°.
Figure 5:
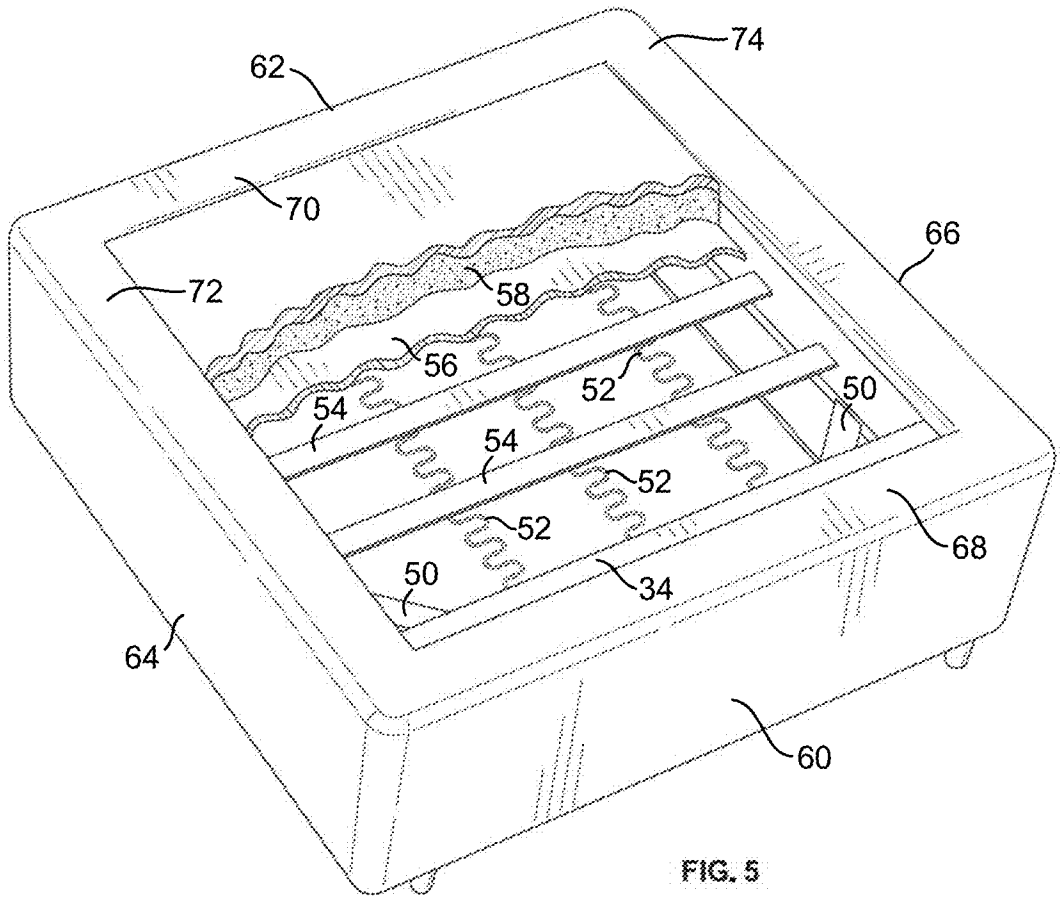
FIG. 5 is a partially cut-away perspective view of the ottoman of FIG. 1 exposing the top portion of the resilient element of the independent suspension system; and, FIG. 6 is a partially exploded perspective view of the ottoman of FIG. 1.

As mentioned, each of the above items of furniture can include an independent suspension system that will inhibit or eliminate wrinkling of the outer fabric, or other material, covering the furniture. FIGS. 3-5 illustrate aspects of an independent suspension system with respect to the ottoman 10 (similar structure(s) can be incorporated in the other types of furniture mentioned).

The independent suspension system includes a support structure 30 and a resilient compressible element or portion 32. The support structure 30 is within the outer box or compartment defined by the outer wall 14 of the base portion 12. The support structure 30 spaces the resilient compressible element 32 from the outer wall 14 of the base portion and positions it below the upper edge of the outer wall 14.

The outer wall 14 of the ottoman 10 includes a first side wall portion 60, a second side wall portion 62 opposing and parallel to the first wall portion 60, a third side wall portion 64 perpendicular to the first side wall portion 60 and the second side wall portion 62, and a fourth side wall portion 66 that is also perpendicular to the first side wall portion 60 and the second side wall portion 62, and is also parallel to the third side wall portion 64. The four side wall portions 60, 62, 64, 66 form a generally square outer perimeter of the base 12.

As shown in the Figures, the support structure 30 includes a first upper horizontal beam 34 that is spaced from and generally parallel to the first side wall portion 60, and a second upper horizontal beam 36 that is spaced from and generally parallel to the second side wall portion 62. Preferably, the beams 34, 36 are spaced from the first and second side wall portions 60, 62, respectively, by approximately four inches.

A leg or support beam 38 is positioned at either end of each of the upper horizontal beam 34, 36. The support beams 38 extend downward to a partial floor portion 40 that extends inward from the outer wall 14 around the bottom interior portion of the base 12.

The support structure 30 also includes a first upper horizontal cross-beam 46, which extends from the first upper horizontal beam 34 to the second upper horizontal beam 36, and a second upper horizontal cross-beam 48 which also extends from the first upper horizontal beam 34 to the second upper horizontal beam 36. Collectively, the beams 34, 36 and cross-beams 46, 48 define a generally rectangular frame (having a rectangular opening) within, and spaced from, the outer wall 14. Small braces 50, can be positioned in the corners of the beams 34, 36 and cross-beams 46, 48 to provide support.

The resilient compressible element 32 is positioned within the opening defined by the beams 34, 36 and cross-beams 46, 48. The resilient compressible element 32 includes a plurality of spaced apart spring elements 52 that extend from the first beam 34 to the second beam 36. The resilient compressible element 32 also includes a plurality of spaced apart elastic bands 54 that extend from the first cross-beam 46 to the second cross-beam 48. A layer of material 56 extends over the opening defined by the beams 34, 36 and cross-beams 46, 48 and covers the spring elements 52 and elastic bands 54.

The support structure is preferably formed from wood. The spring elements are preferably formed from metal, and the elastic bands are preferably formed from a textile containing elastomeric materials. Other similar or suitable materials can also be used for the components of the suspension system.

The spring elements 52 and elastic bands 54 are covered by one or more layers of material (e.g., a fabric) 56 that extends over the opening defined by the beams 34, 36 and cross-beams 46, 48, and which can be secured thereto. The material 56 provides an upper surface for the resilient compressible element 32. The upper surface is positioned several inches below a top edge of the each of the side wall portions 60, 62, 64, 66 and is centrally located within the base 12. As shown in FIGS. 3 and 5, a layer of padding or cushioning 58 is placed over the material layer 54 of the resilient compressible element 32.

Referring to FIGS. 3A, 3B, 5 and 6, the base includes top segments 68, 70, 72, 74 that extend inwardly from a top edge of each of the side wall portions 60, 62, 64, 66, respectively. The segments 68, 70, 72, 74 (which may include additional materials as described below), have an upper surface that is angled downward from the top of the side wall portion.

Figure 3A:
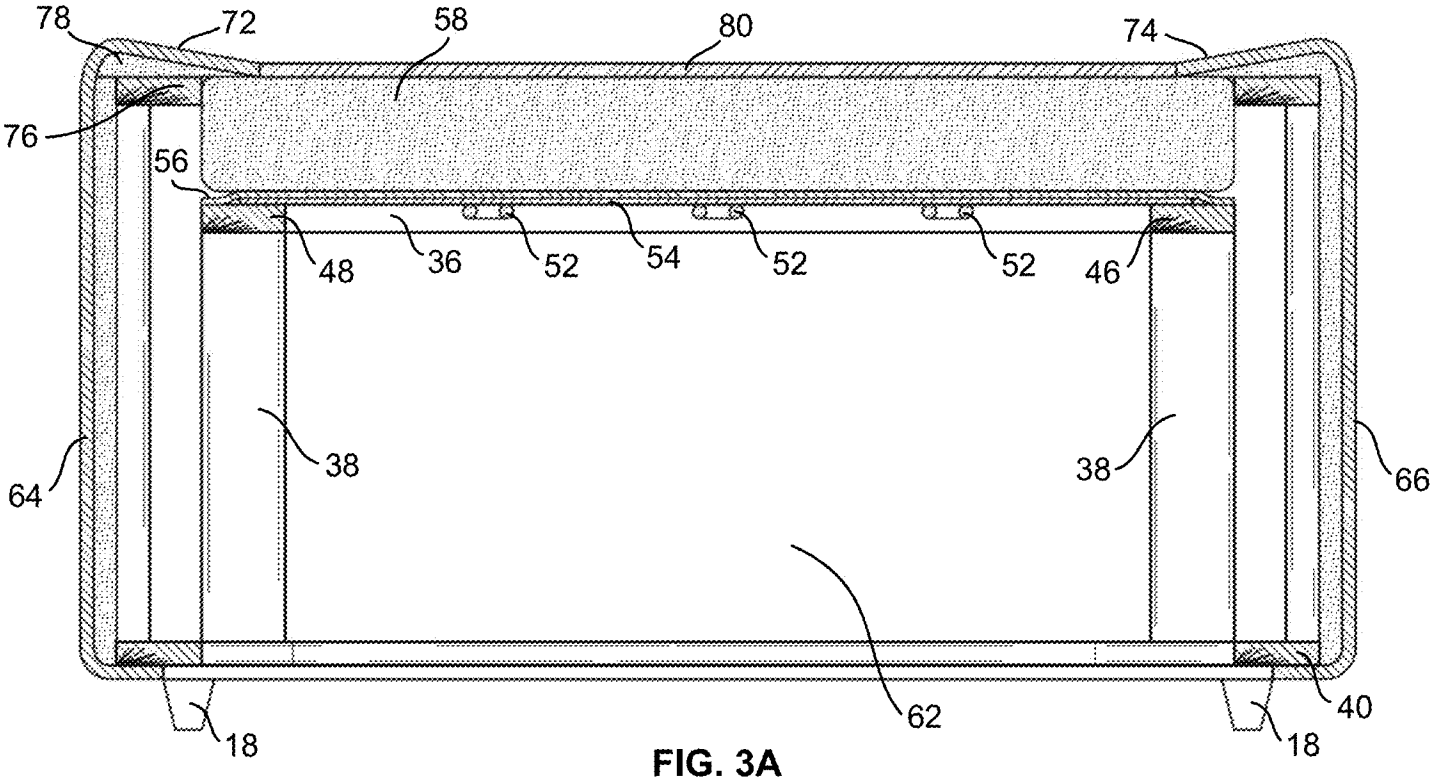
FIG. 3A is a cross-sectional view of the ottoman of FIG. 1 across the plurality of spring elements.
Figure 3B:
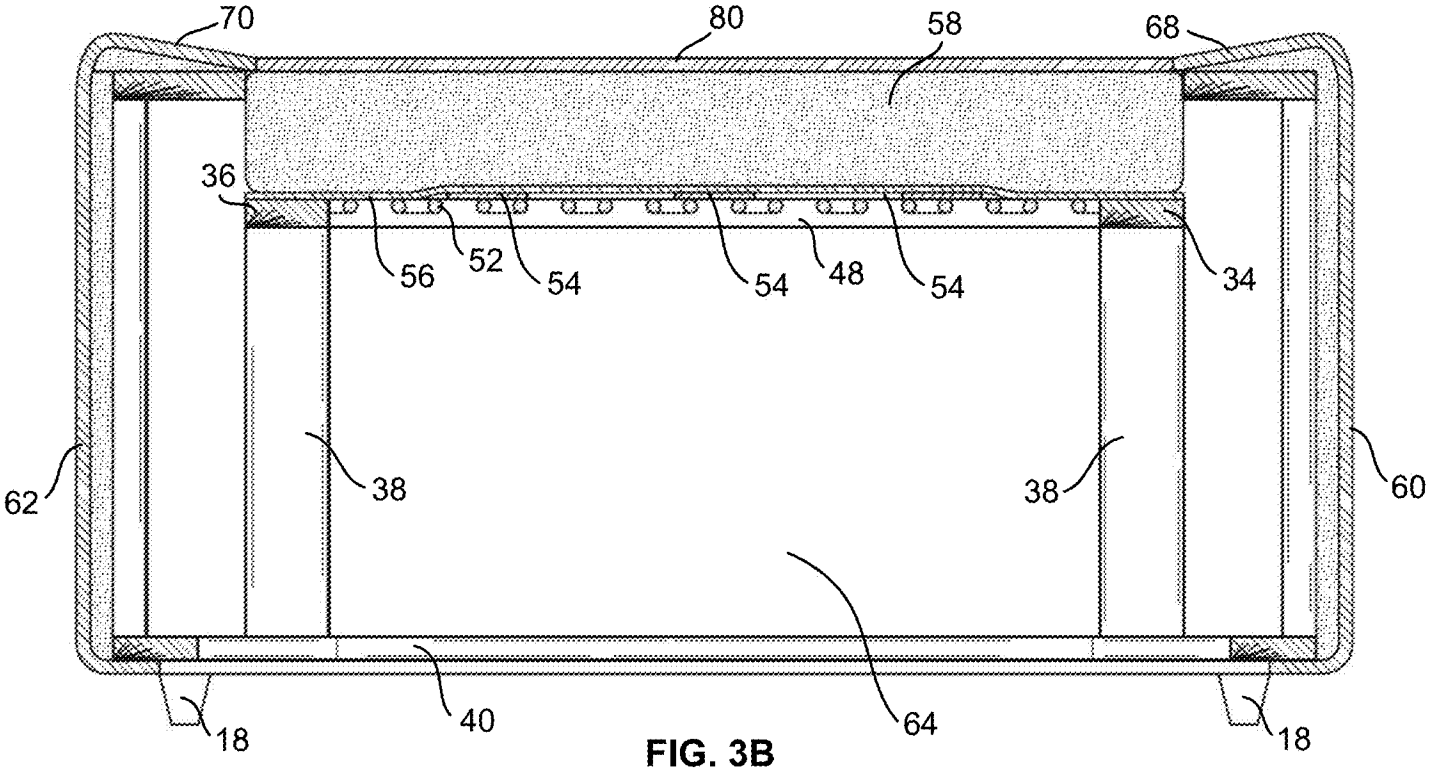
FIG. 3B is a cross-sectional view of the ottoman of FIG. 1 through a middle one of the plurality of spring elements.

Referring to FIGS. 3A and B, the segments include an inwardly directed horizontal top portion 76 extending from a top edge of the side wall 14. A layer of padding or cushioning 78 extends over a top surface of the top portion 76, and continues along the outer side wall 14. An outer layer of material (e.g., a fabric) 80 extends over the padding layer 78. As is evident in the Figures, the upper surface of the outer layer of material 80 is inclined inwardly at a downward slant and then extends generally horizontally over the cushion layer 58 positioned on the resilient compressible element 32.

By spacing the suspension system from the outer wall of the base, the system essentially forms an inner box within (and spaced from) an outer box formed by the side wall portions. This positioning of the suspension system is found to inhibit or eliminate bunching or wrinkling of outer material covering the base.

While the side wall portions 60, 62, 64, 66 of the base 12 of the ottoman 10 form a square or rectangular shape (similar to other furniture, such as portions of the sectional couch 20) other pieces of furniture can have a base with fewer (e.g., the pie shaped corner piece 26 in FIG. 2) or more than four side portions (e.g., an ottoman with an octagonal shape—not shown). In those instances, the suspension system can be formed with a rectangular frame as described or with a matching interior frame (having the same number of sides as the base), or other configuration that is spaced from the outer wall of such pieces of furniture.

Many modifications and variations of the present invention are possible in light of the above teachings. It is, therefore, to be understood within the scope of the appended claims the invention may be protected otherwise than as specifically described.

I claim:

1. A seating system with an independent suspension system comprising:

a base having an outer side wall having a first side wall portion, a second side wall portion opposing and spaced from the first side wall portion, a third side wall portion and a fourth side wall portion opposing and spaced from the third side wall portion defining an outer side perimeter of the seating system and an upper opening;

a suspension system positioned within the perimeter of the outer side wall and spaced from the outer side wall, the suspension system having a support structure having a first beam having a top edge at a first height, a second beam having a top edge at the first height parallel to the first beam, a first cross-beam having a top edge at the first height and a second cross-beam having a top edge at the first height parallel to the first cross-beam and a resilient compressible element connected to the support structure, the resilient compressible element supported above a bottom of the base by the support structure and extending from and between the top edge of the first beam and the top edge of the second beam and the top edge of the first cross beam and the top edge of the second cross-beam, the resilient compressible element having an upper support surface wherein the support structure spaces the resilient compressible element from the first side wall portion, the second side wall portion, the third side wall portion and the fourth side wall portion of the outer side wall;

a cushion layer supported on the upper support surface of the resilient compressible element; and, an outer layer of material covering the cushion layer and spanning the opening defined by the outer side wall.

2. The seating system of claim 1 wherein the support structure positions the resilient compressible element below a top of the outer side wall.

3. The seating system of claim 1 wherein the support structure includes a first beam extending from the third side wall portion to the fourth side wall portion and spaced from the first side wall portion, and second beam extending from the third side wall portion to the fourth side wall portion and spaced from the fourth side wall portion.

4. The seating system of claim 3 wherein the support structure includes a first cross-beam extending from the first beam to the second beam and a second cross-beam extending from the first beam to the second beam and spaced from the first cross-beam.

5. The seating system of claim 1 wherein the resilient compressive element includes a plurality of spring elements.

6. The seating system of claim 5 wherein the resilient compressive element includes a plurality of elastic straps.

7. The seating system of claim 6 wherein each of the plurality of spring elements extend from the first beam to the second beam.

8. The seating system of claim 6 wherein each of the plurality or elastic elements extend from the first cross-member to the second cross-member.

9. The seating system of claim 8 wherein the resilient compressive element includes a layer of material above the plurality of spring elements and the plurality of elastic straps, the layer of material having an upper surface.

10. The seating system of claim 9 wherein the cushion layer is supported on the upper surface of the layer of material of the resilient compressive member.

11. The seating system of claim 1 wherein the base is part of an ottoman.

12. A seating system having an independent suspension system comprising:

a base portion having a first side wall portion, a second side wall portion spaced from and parallel to the first side wall portion, a third side wall portion perpendicular to the first side wall portion and the second side wall portion and a fourth side wall portion spaced from and parallel to the third side wall portion, wherein the first side wall portion, the second side wall portion, the third side wall portion and the fourth side wall portion form a generally rectangular outer wall of the base portion;

a support structure within the outer wall of the base portion having a first beam having a top edge at a first height spaced from and parallel to the first side wall portion and a second beam having a top edge at the first height spaced from and parallel to the second side wall portion, a first cross-beam having a top edge at the first height spaced from and parallel to the third side wall portion and a second cross-beam having a top edge at the first height spaced from and parallel to the fourth side wall portion; and, a compressible portion connected to and extending from and between the top edge of the first beam and the top edge of the second beam, and the top edge of the first cross-beam and the top edge of the second cross beam and spaced above a bottom portion of the seating system.

13. The seating system of claim 12 wherein the compressible portion includes a plurality of spring elements extending from the first beam to the second beam.

14. The seating system of claim 13 wherein the compressible portion includes a plurality of elastic bands extending from the first cross-beam to the second cross-beam.

15. The seating system of claim 12 including an outer material covering a top portion of the base portion.

16. The seating system of claim 12 wherein the seating system is an ottoman.

* * * * *